US006503009B2

(12) United States Patent
Naitou

(10) Patent No.: US 6,503,009 B2
(45) Date of Patent: Jan. 7, 2003

(54) RECORDING PAPER CUTTING MECHANISM

(75) Inventor: Hideki Naitou, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/905,430

(22) Filed: Jul. 13, 2001

(65) Prior Publication Data

US 2002/0006304 A1 Jan. 17, 2002

(30) Foreign Application Priority Data

Jul. 17, 2000 (JP) ..... 2000-221075

(51) Int. Cl.[7] ..... B41J 1/70
(52) U.S. Cl. ..... 400/621; 400/663; 83/614
(58) Field of Search ..... 400/621, 621.1, 400/663, 668; 83/627, 614, 629, 620

(56) References Cited

U.S. PATENT DOCUMENTS 4,936,177 A * 6/1990 Ozawa et al. ..... 83/582
4,981,059 A * 1/1991 Kobayashi ..... 400/621
5,001,955 A * 3/1991 Fujiwara ..... 83/488
5,088,370 A * 2/1992 Kondo ..... 241/32
5,235,887 A * 8/1993 Moriya ..... 83/140
5,663,804 A 9/1997 Kataoka et al. ..... 358/304
6,109,154 A * 8/2000 Miyatsu et al. ..... 83/202
6,145,561 A * 11/2000 Watanabe et al. ..... 156/517
6,152,007 A * 11/2000 Sato ..... 83/202
6,347,896 B1 * 2/2002 Robinson ..... 400/613

FOREIGN PATENT DOCUMENTS

DE 4024615 A1 * 2/1992 ..... B26D/1/06
JP Hei 5-246093 9/1993
JP 2628686 4/1997

* cited by examiner

*Primary Examiner*—Daniel J. Colilla
*Assistant Examiner*—Dave A. Ghatt
(74) *Attorney, Agent, or Firm*—Brinks Hofer Gilson & Lione

(57) ABSTRACT

The present invention automatically returns a movable cutter to its home position if the recording paper jams during cutting to cut and remove the jammed part of the recording paper. The shifting of a movable cutter away from its home position by the revolution of a drive motor causes the movable cutter to cut recording paper and, after cutting the recording paper, the return of the movable cutter to its home position causes a swinging board to be released from restraint by a locking member to enable the swinging board to swing again and the rotation of a drive gear previously transmitted to a spiral shaft to be transmitted to a recording paper feed roller.

7 Claims, 8 Drawing Sheets

RECORDING PAPER CUTTING MECHANISM

BACKGROUND OF THE INVENTION

1. Field of the Invention

The present invention relates to a recording paper cutting mechanism, and more particularly to a recording paper cutting mechanism capable of cutting paper into a sheet of a desired length.

2. Description of the Related Art

Printers according to the prior art having a recording paper cutting mechanism configured to be capable of cutting printed thermosensitive recording paper, for instance rolled recording paper, into a sheet of a required length, include ones at used in supermarkets and elsewhere to print receipts to be issued to customers when they have paid for their purchases.

A recording paper cutting mechanism used in such a printer may be provided with a fixed cutter (not shown) formed longer than the width of the recording paper used and a movable cutter capable of moving along this fixed cutter. The movable cutter, when not cutting paper, is in its home position and linked to a spiral shaft which can transmit the revolution of a drive motor.

The revolution of the drive motor drives the spiral shaft to shift the movable cutter along the fixed cutter and to cut the recording paper.

The thermosensitive recording paper printed by a thermal head can be fed, by the rotation of a paper feed roller toward the fixed cutter arranged farther downstream than a printing section by a desired length.

When the recording paper is to be cut, the drive motor is turned in a first direction, and this revolution is transmitted to the spiral shaft to shift the movable cutter along the fixed cutter so as to cut the recording paper into a sheet of a desired length. After the cutting is completed, the movable cutter returns to its home position.

During the process of cutting by shifting the movable cutter, the drive motor is disconnected from the paper feed roller, whose rotation is stopped so as not to feed the paper.

After the recording paper is cut and the movable cutter returns to its home position, the drive motor is turned in the reverse direction to disconnect the drive motor from the spiral shaft, and the reverse revolution of the drive motor is transmitted to the paper feed roller, which is thereby turned to feed a desired length of the printed paper toward the fixed cutter.

After that, by turning the drive motor in the first direction again, the movable cutter is shifted away from its home position and the printed paper is thereby cut into a sheet of a desired length.

Such a recording paper cutting mechanism, having advantages of simple structure and capability to cut the recording paper neatly straight, is extensively used for cutting printed receipts in, for instance, cash register machines in supermarkets and elsewhere.

However, the recording paper cutting mechanism according to the prior art involves the problem that if, during its paper cutting operation, the cutting by the movable cutter is stopped by jamming of the paper or the like, the drive motor also stops turning with the power supply to it remaining active.

This makes it necessary to reverse the spiral shaft by hand after once turning off the power supply to the drive motor, return the movable cutter to its home position, feed ahead the jammed part of the recording paper by a prescribed length, and cut off the jammed part of the paper with the movable cutter.

Thus, the conventional recording paper cutting mechanism involves the operational inconvenience that, if any trouble, such as recording paper jamming, occurs while the paper is being cut, the movable cutter should be manually returned to its home position.

SUMMARY OF THE INVENTION

The present invention, attempted in view of the problem noted above, is intended to provide a conveniently operable recording paper cutting mechanism that automatically returns a movable cutter, if it is stopped by any trouble occurring while the paper is being cut, such as recording paper jamming, to its home position and allows the jammed part of paper to be cut off and removed.

A recording paper cutting mechanism as a first means to solve the problem according to the invention has a configuration comprising:

a drive motor; cutting means consisting of a fixed cutter and a movable cutter capable of moving along this fixed cutter; a rotatable spiral shaft having spiral grooves for shifting the movable cutter; a rotatable paper feed roller for feeding recording paper toward the cutting means; a swinging board capable of swinging according to the revolving direction of the drive motor; a swinging gear fitted swingably to the swinging board and capable of selectively transmitting the revolution of the drive motor to either the spiral shaft or the paper feed roller according to the swinging direction of the swinging board; and a locking member capable of restraining the swinging of the swinging board when cutting the paper by turning the spiral shaft to shift the movable cutter along the fixed cutter.

A recording paper cutting mechanism as a second means to solve the problem according to the invention has a configuration wherein:

the movable cutter is in its home position before cutting recording paper; the recording paper is cut by turning the spiral shaft by the revolution of the drive motor to shift the movable cutter away from the home position; and, after paper cutting, the return of the movable cutter to the home position releases the swinging of the swinging board from the restraint by the locking member to enable the swinging board to swing, followed by reversing the revolution of the motor which causes the swinging board to swing thereby to enable the revolution of the drive motor to be transmitted to the paper feed roller.

A recording paper cutting mechanism as a third means to solve the problem according to the invention has a configuration wherein:

a detecting member capable of detecting the return of the movable cutter to the home position is provided, and detection by this detecting member of the return of the movable cutter to the home position causes the drive motor to turn in the reverse direction.

A recording paper cutting mechanism as a fourth means to solve the problem according to the invention has a configuration wherein:

a control unit is further provided for detecting the stop of the drive motor when the shifting of the movable cutter stops while cutting the recording paper and the drive motor stops, and the control unit, if it detects that the drive motor remains stopped for a prescribed length of time or longer, reverses the revolving direction of the drive motor to reverse the rotation of the spiral shaft and thereby to return the movable cutter to the home position.

A recording paper cutting mechanism as a fifth means to solve the problem according to the invention has a configuration wherein:

the locking member consists of an elastically deformable plate member, and the return of the movable cutter to the home position causes the movable cutter to elastically deform the movable locking member to release the swinging board from the restraint.

A recording paper cutting mechanism as a sixth means to solve the problem according to the invention has a configuration wherein:

the locking member has a restraining section formed by folding, at a right angle, part of its peripheral part, and the restraining section engages an end face of the swinging board to restrain the swinging of the swinging board.

A recording paper cutting mechanism as a seventh means to solve the problem according to the invention has a configuration wherein:

the locking member has a restraint releasing section in part of the restraining section, and the operation of the restraint releasing section when the movable cutter returns to its home position disengages the swinging board.

DETAILED DESCRIPTION OF THE PREFERRED EMBODIMENTS

Figure 1:
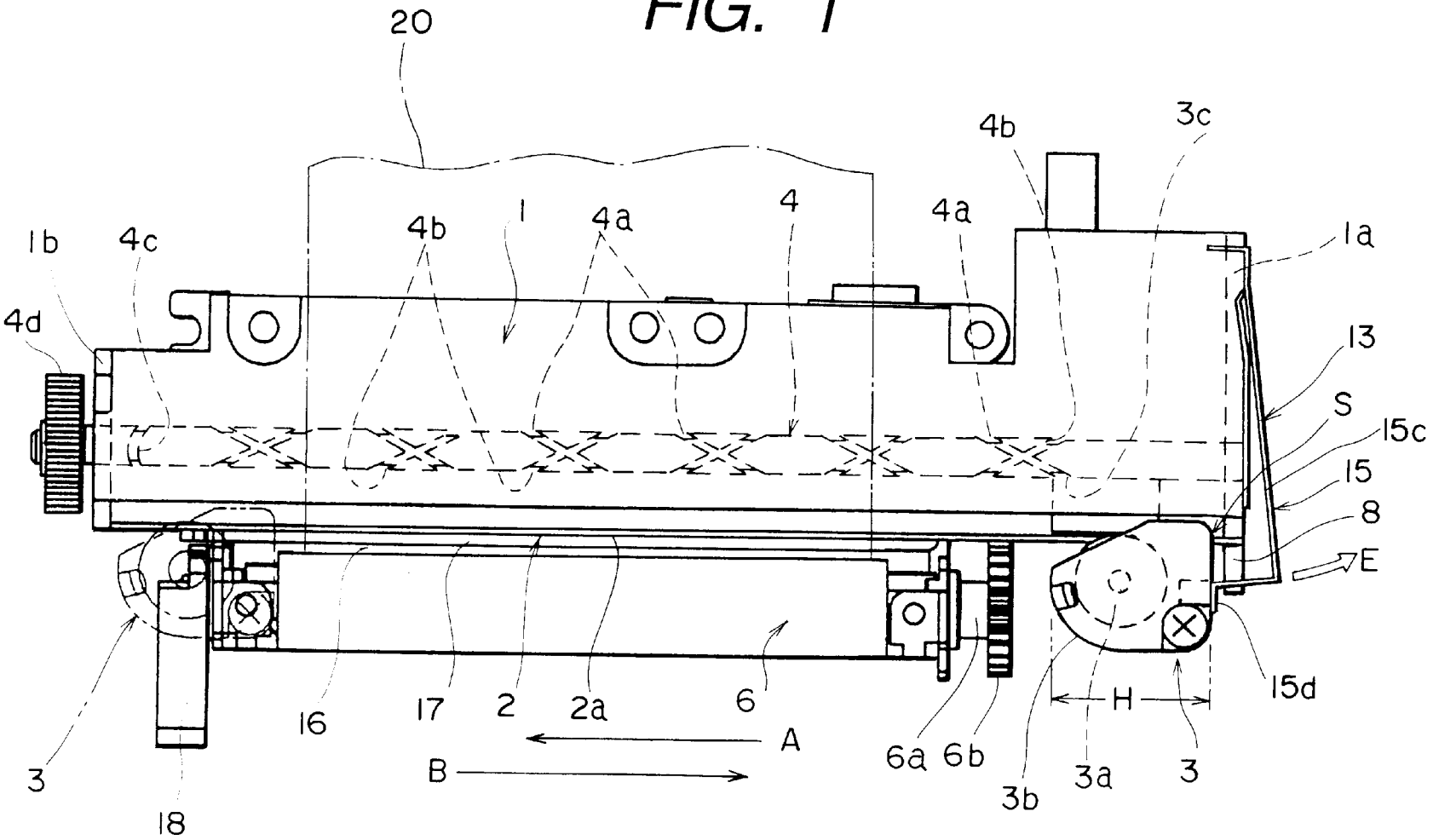
FIG. 1 is a plan of a movable cutter pertaining to the present invention when it is in its home position.
Figure 2:
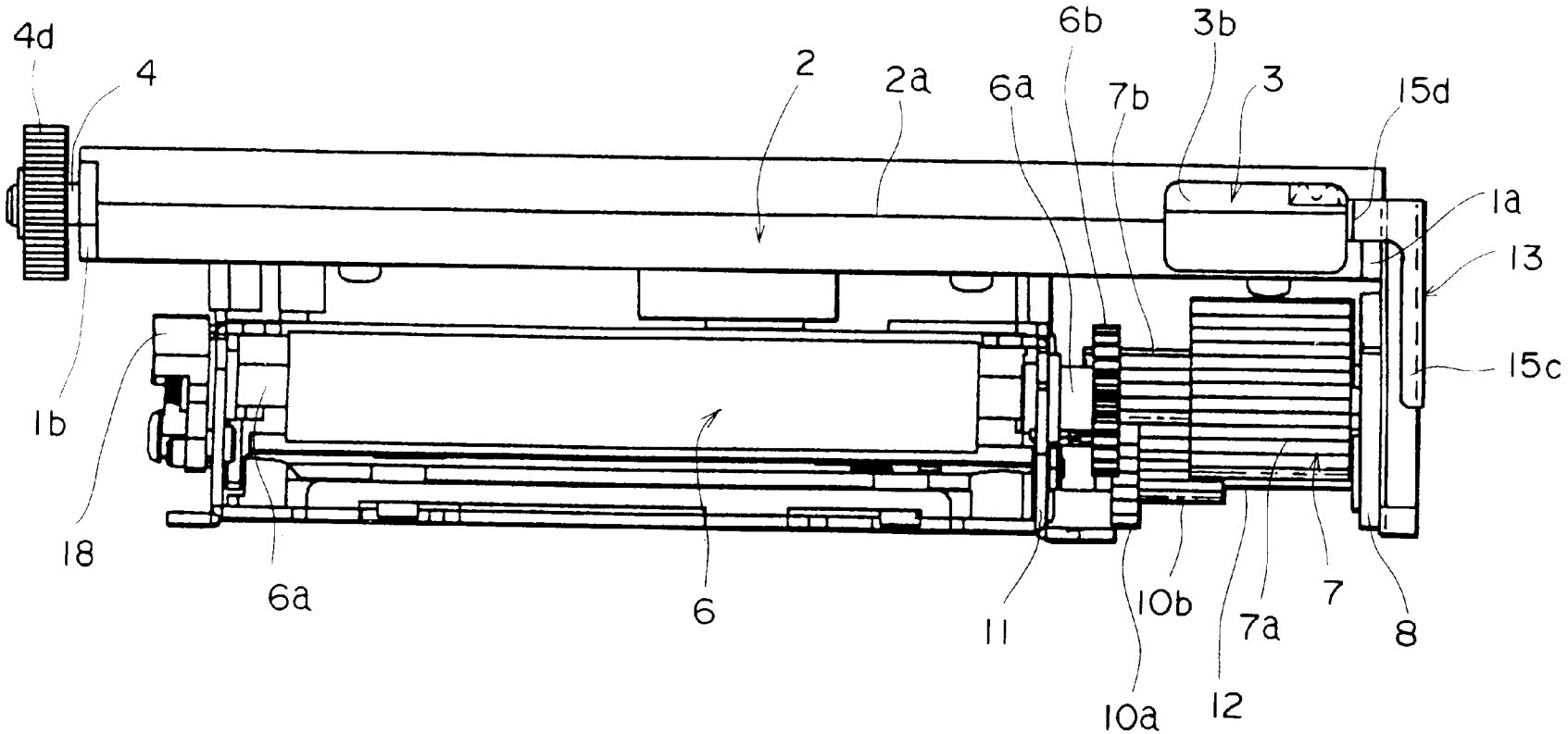
FIG. 2 is a front view of FIG. 1.
Figure 3:
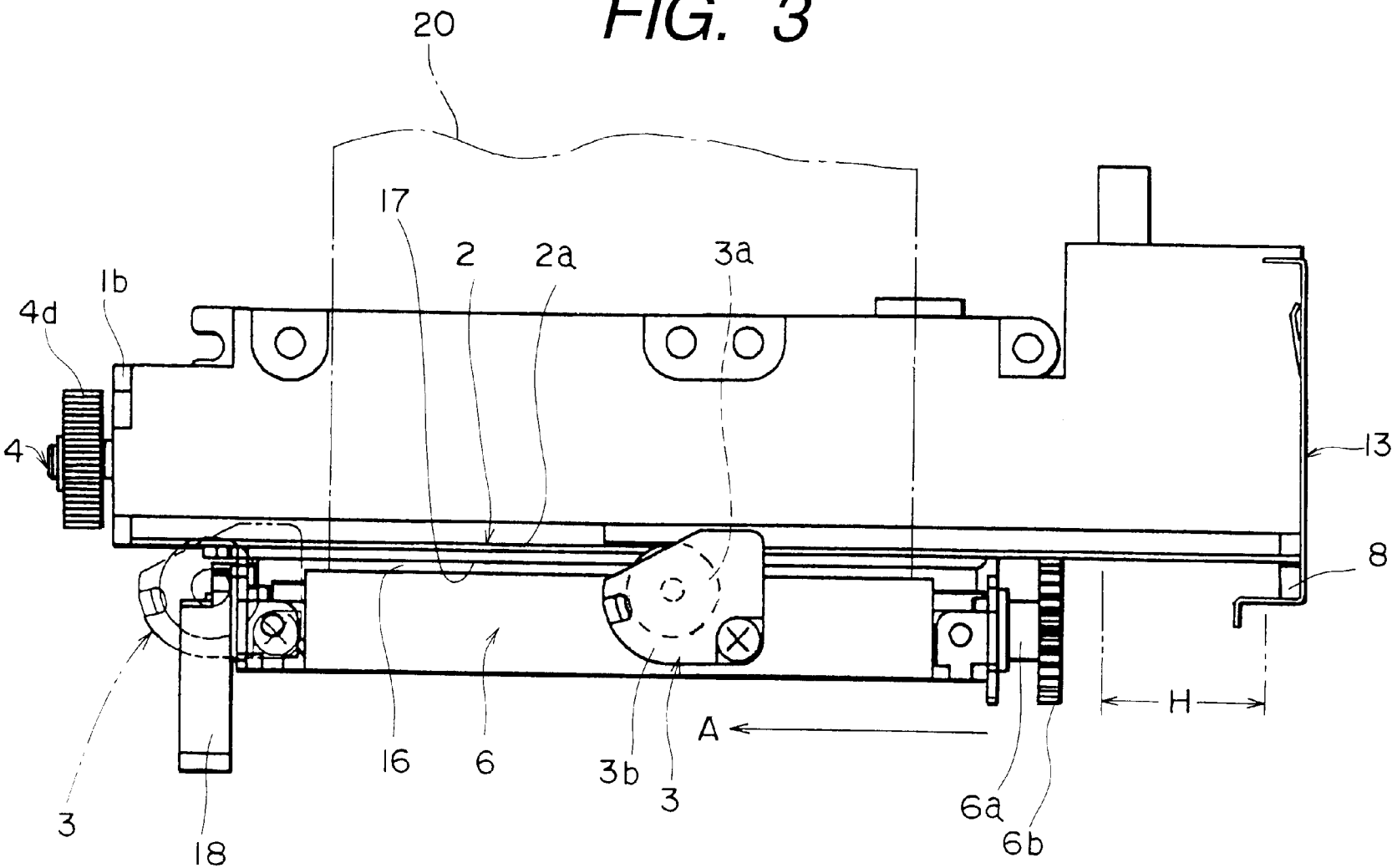
FIG. 3 is a plan of the movable cutter pertaining to the invention when it is on the way of shifting.
Figure 4:
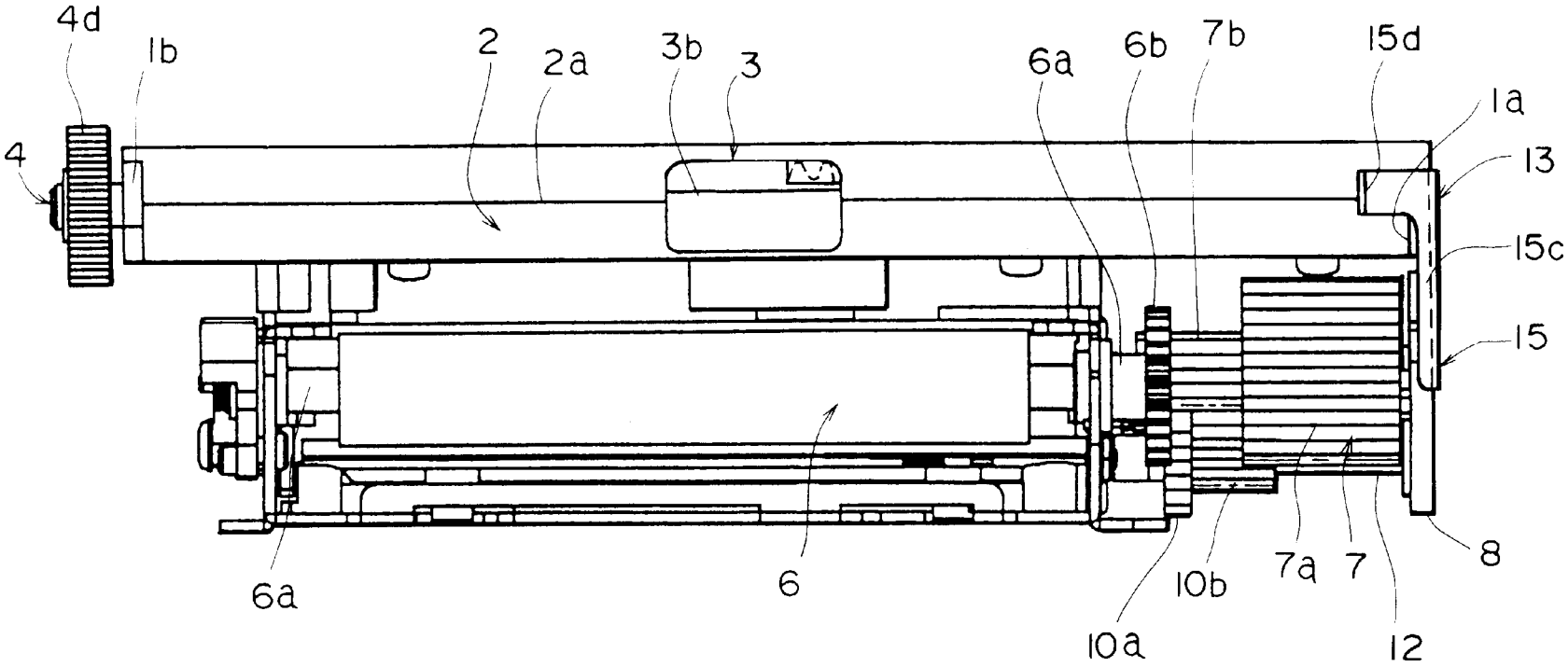
FIG. 4 is a front view of FIG. 3.
Figure 5:
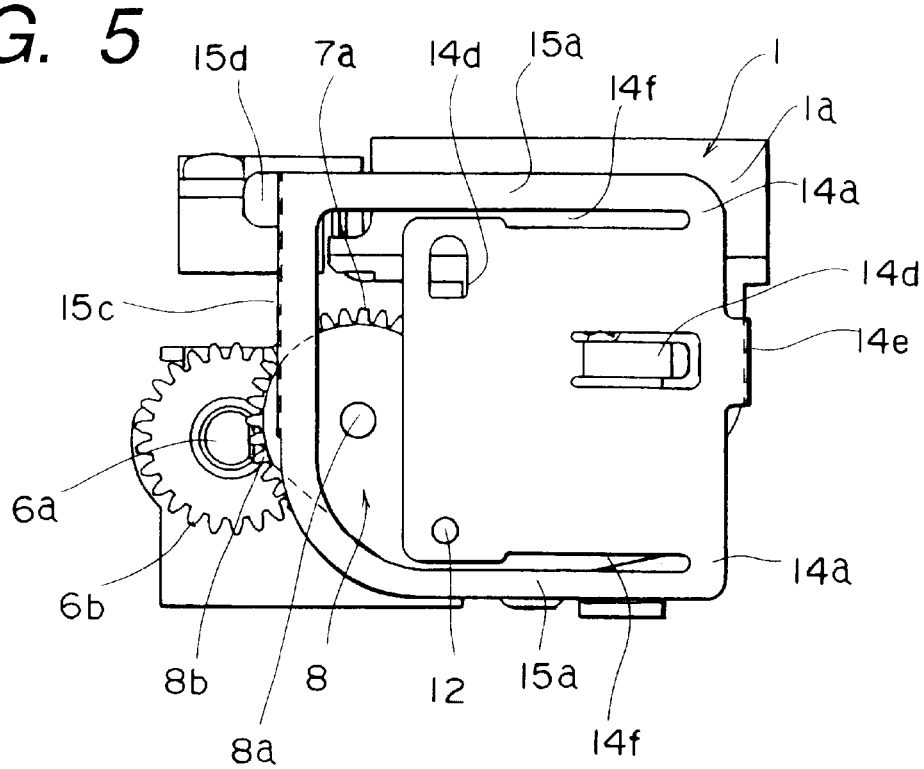
FIG. 5 is a right side profile of FIG. 2.
Figure 6:
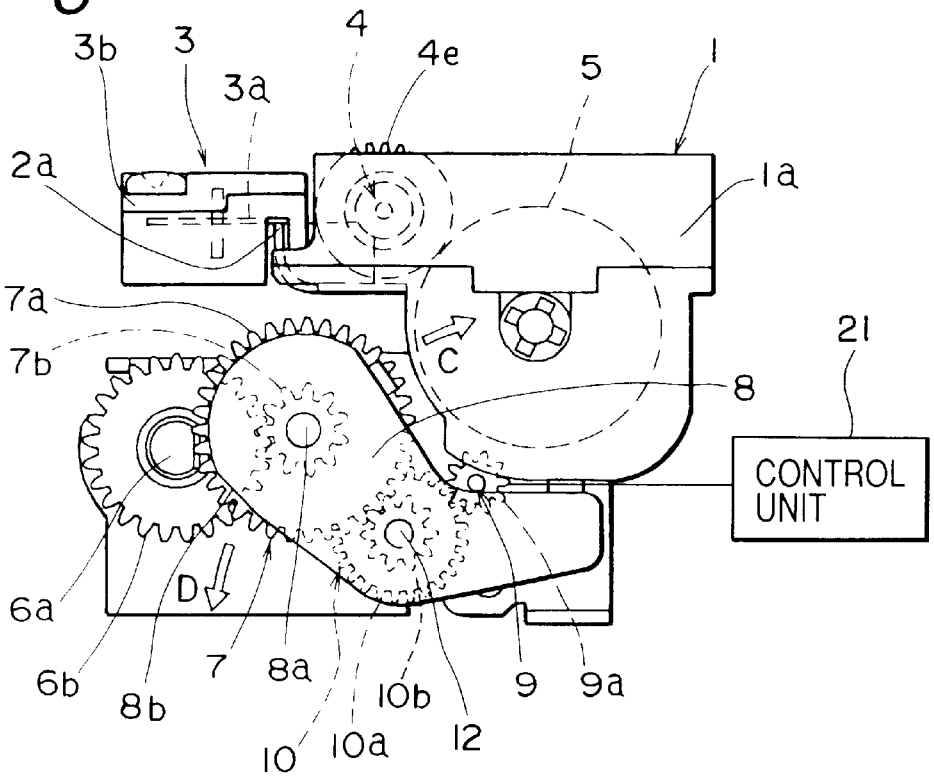
FIG. 6 illustrates the motion of the swinging board shown in FIG. 5.
Figure 7:
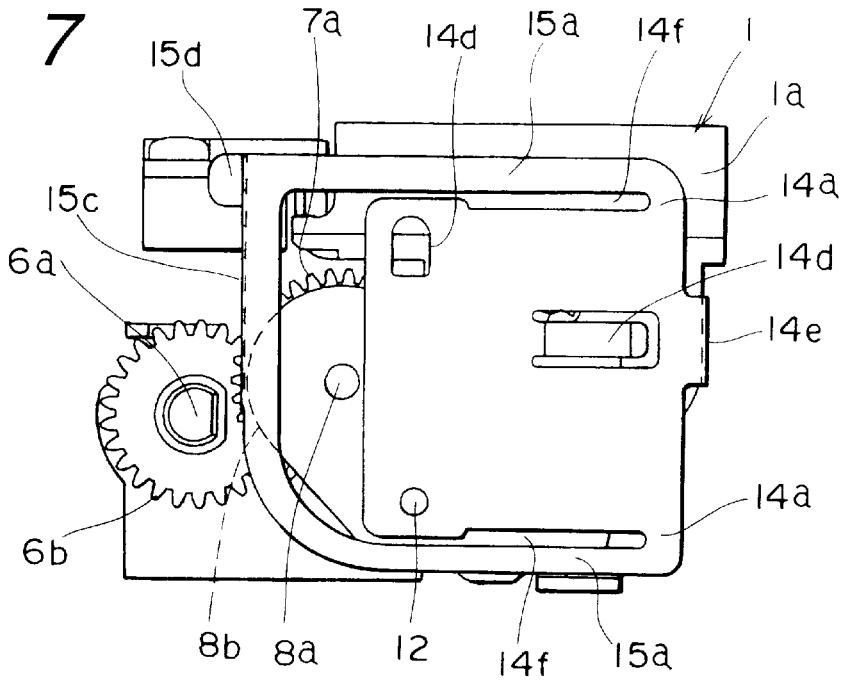
FIG. 7 is a right side profile of FIG. 4.
Figure 8:
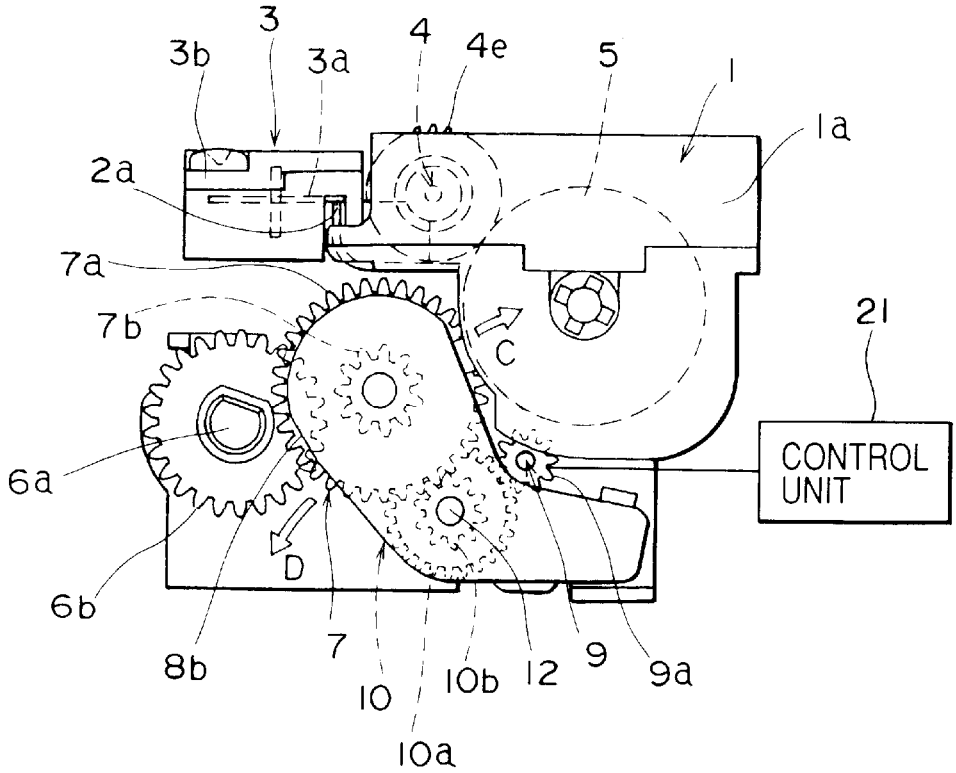
FIG. 8 illustrates the motion of the swinging board shown in FIG. 7.
Figure 9:
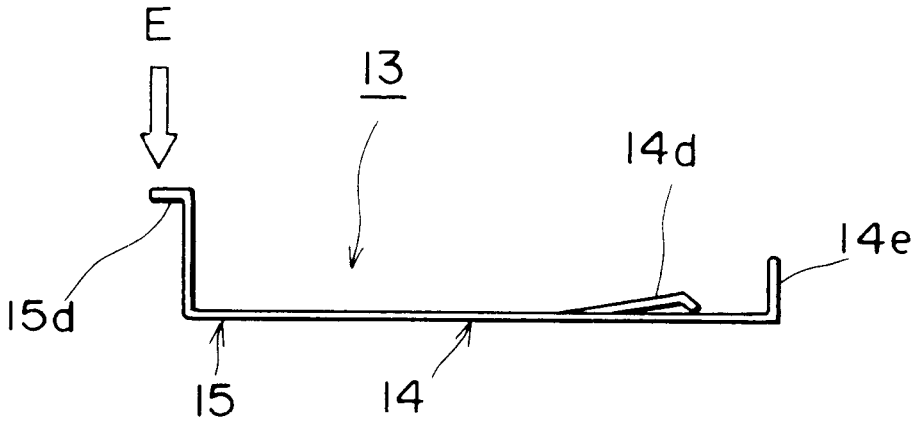
FIG. 9 is a plan of a locking member pertaining to the invention.
Figure 10:
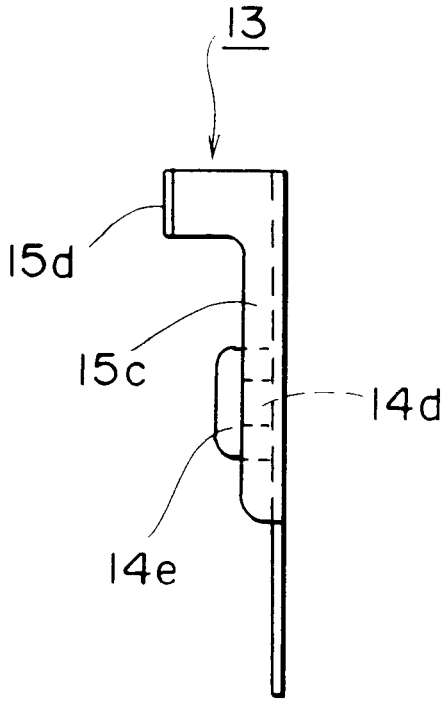
FIG. 10 is a profile of a locking member pertaining to the invention.
Figure 11:
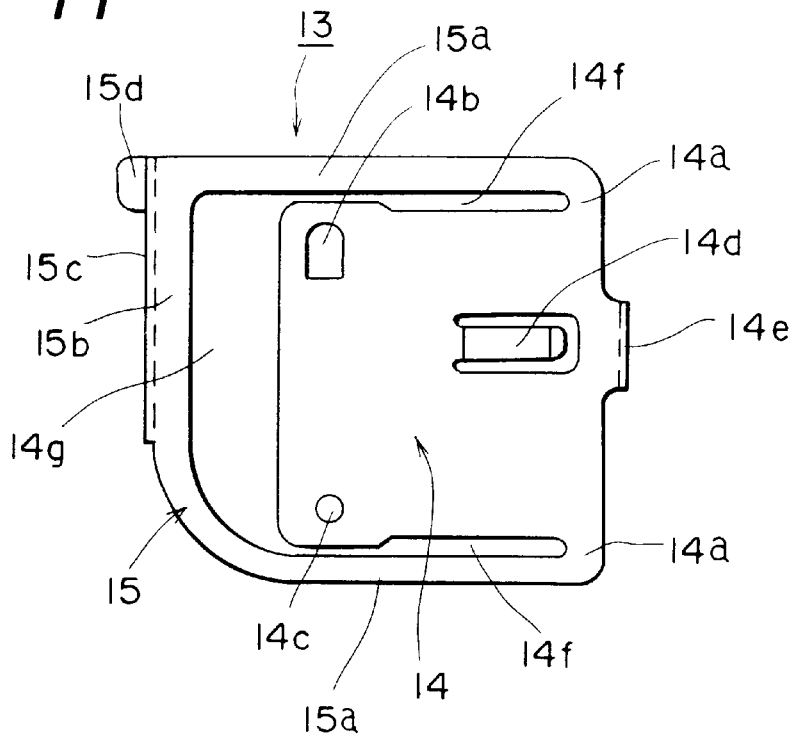
FIG. 11 is a front view of a restraining member pertaining to the invention.

The recording paper cutting mechanism according to the present invention will be described in detail below with reference to FIGS. 1 through 12. First, FIG. 1 is a plan of a movable cutter pertaining to the present invention when it is in its home position; FIG. 2, a front view of FIG. 1; FIG. 3, a plan of the movable cutter pertaining to the invention when it is on the way of shifting; FIG. 4, a front view of FIG. 3; FIG. 5, a right side profile of FIG. 2; FIG. 6 illustrates the motion of the swinging board shown in FIG. 5; FIG. 7, a right side profile of FIG. 4; FIG. 8 illustrates the motion of the swinging board shown in FIG. 7; FIG. 9, a plan of a locking member pertaining to the invention; FIG. 10, a profile of a locking member pertaining to the invention; FIG. 11, a front view of a restraining member pertaining to the invention; and FIG. 12, an expanded view of the essential part of a spiral shaft pertaining to the invention.

As illustrated in FIG. 1, underneath a frame 1 consisting of a resin material, there is arranged a fixed cutter 2 having a laterally long cutter section 2*a* formed by folding a metal plate at a substantially right angle.

There also is a movable cutter 3, which can be shifted along the lengthwise direction of the cutter section 2*a* of this fixed cutter 2, positioned in its home position H shown in FIG. 1. The fixed cutter 2 and the movable cutter 3 constitute a cutting means which can cut recording paper 20.

The movable cutter 3 has a disk-shaped rotary cutter 3*a* fitted rotatably within a carriage 3*b*. The carriage 3*b* extends within the frame 1 to constitute an engaging section 3*c* to engage into spiral grooves 4*a* and 4*b* of a spiral shaft 4 to be described later.

Within the frame 1 wherein the engaging section 3*c* of the movable cutter 3 is located, the long spiral shaft 4 is rotatably arranged in a direction parallel to the cutter section 2*a* of the fixed cutter 2.

Figure 12:
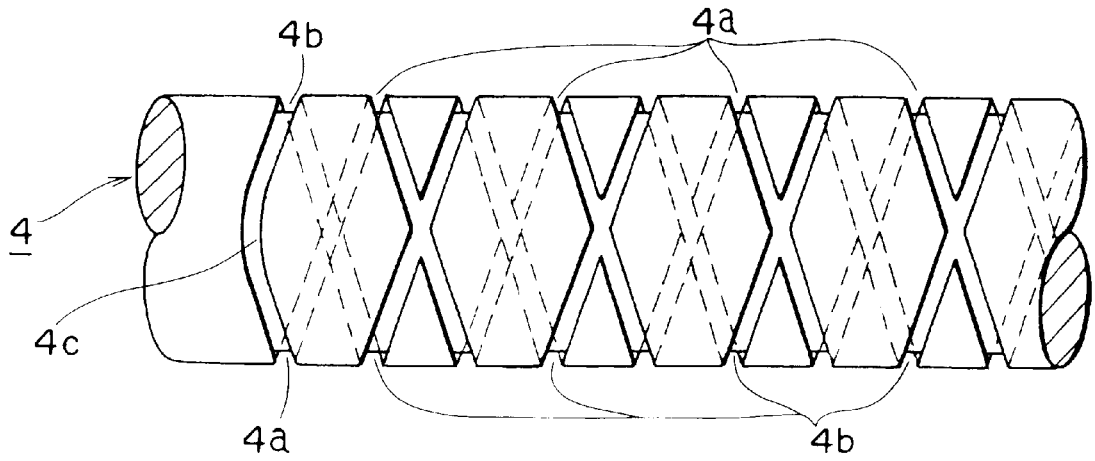
FIG. 12 is an expanded view of the essential part of a spiral shaft pertaining to the invention.

This spiral shaft 4, as shown in FIG. 12, has a single spiral groove as the first spiral groove 4*a* and the second spiral groove 4*b* threaded in a direction reverse to this first spiral shaft 4*a*, both spirally threaded on the circumference, are connected by linking grooves 4*c* at right and left ends.

Because of this arrangement of the grooves, even if the spiral shaft is turned in one direction to shift the movable cutter 3 from its home position H in the direction of arrow A and the movable cutter 3 reaches the end of shifting indicated by the two-dot chain line, further turning of the spiral shaft 4 in the same direction can reverse the shifting direction of the movable cutter 3 from arrow A to arrow B to enable the movable cutter 3 to return to its home position H.

At the left end of the spiral shaft 4 protruding in the leftward direction of the left side wall 1*b* of the frame 1, there is pivoted a manual gear 4*d* to enable the spiral shaft 4 to be turned manually.

Within the frame 1 near its left side wall 1*a*, as shown in FIG. 6, there is pivoted, toward the left end of the spiral shaft 4, a first gear 4*e* that can transmit the revolution of a drive motor 9 to be described later to the spiral shaft 4.

With this first gear 4*e*, a rotatable first intermediate gear 5 arranged within the frame 1 engages to make the revolution of the drive motor 9 transmissible via the first intermediate gear 5.

Underneath the fixed cutter 2, which is long in the lateral direction as shown in FIG. 1, there is arranged a rotatable paper feed roller 6 that can feed recording paper 20 toward a cutting means S. At the right end in the drawing of the rotation axis 6*a* of this paper feed roller, there is pivoted a second gear 6*b* that can transmit the revolution of the drive motor 9 to the paper feed roller 6.

To the right of the second gear 6*b* shown in FIG. 2, there is rotatably fitted to a fixed shaft 8*a*, pivoted in a direction vertical to a swinging board 8, a swinging gear 7 integrally formed of a gear 7*a* and a pinion 7*b*.

The swinging board 8, as shown in FIG. 6, is punched out of a metal plate and formed in a substantially L shape, and a supporting shaft 12 is swingably fitted to it to enable the swinging board 8 to swing pivoting on the supporting shaft 12.

The swinging board 8 shown in FIG. 6 has a left end face 8*b* on the left side of the circumference in the drawing, and this left end face 8*b* can be engaged with the restraining section 15*c* of a locking member 13 to be described below, and the engagement of the left end face 8*b* with the restraining section 15*c* enables the swinging of the swinging board 8 to be restrained.

A drive gear 9*a* shown in FIG. 6 is directly connected to the drive motor 9, and a second intermediate gear 10 is always engaged with the drive gear 9*a*. This second intermediate gear 10 is integrally formed of a gear 10*a* and a pinion 10*b*. The drive gear 9*a* is always engaged with the gear 10*a*, and the gear 7*a* of the swinging gear 7 is always engaged with the pinion 10*b*.

In the paper feed roller 6 shown in FIG. 2, the rotation axis 6*a* is rotatably pivoted on a side plate 11 consisting of a metal plate, and on the supporting shaft 12 fixed to this side plate 11 is rotatably pivoted the second intermediate gear 10.

The tip of the supporting shaft 12 supports the swinging board 8, which, pivoting on the supporting shaft 12, can swing in the directions of arrows C and D. If the drive gear 9*a* of the drive motor 9 rotates in, for instance, the counterclockwise direction which is a first direction, the swinging board 8, pivoting on the supporting shaft 12, will swing in the direction of arrow C; the gear 7*a* of the swinging gear 7 will engage with the first intermediate gear 5; and the revolution of the drive motor 9 will be transmitted from the first intermediate gear 5 to the first gear 4*e* to turn the spiral shaft 4 in the counterclockwise direction.

If the drive gear 9*a* of the drive motor 9 rotates in, for instance, the clockwise direction which is a second direction, the swinging board 8, pivoting on the supporting shaft 12, will swing in the direction of arrow D; the pinion 7*b* of the swinging gear 7 will engage with the second gear 6*b* pivoting on the paper feed roller 6; and the revolution of the drive motor 9 will be transmitted to the paper feed roller 6 to turn the paper feed roller 6 in the counterclockwise direction.

The locking member 13 consisting of an elastically deformable plate, such as a stainless steel plate, is fitted to the external surface of the right side plate 1*a* of the frame 1 shown in FIG. 1. This locking member 13, as shown in FIG. 11, is formed in a substantially rectangular shape, and has a base 14 that can be fitted in tight adherence to the right side plate 1*a* of the frame 1. At the top and the bottom of this base 14 toward its right end in the drawing are formed a pair of fulcrums 14*a*.

At the top and the bottom of this base 14 toward its left end are respectively formed a round-topped oblong fitting hole 14*b* for fitting the base 14 to the right side plate 1*a* of the frame 1 and a round hole 14*c* for fitting it to the supporting shaft 12.

In approximately the middle of the base 14 in the vertical direction is formed a substantially L-shaped protrusion 14*d* as shown in FIG. 9, and at the right end of the base 14 close to this protrusion 14*d* is formed by cut-raising a tongue-shaped positioner 14*e*.

Outside the base 14 shown in FIG. 11 is formed an arm 15, and this arm 15 has a pair of arm pieces 15*a* outside the base 14 at the top and the bottom with one each of first slits 14*f* in-between. The right side in the drawing of each of these arm pieces 15*a* is connected to the corresponding one of the fulcrums 14*a* to integrate the arm 15 with the base 14.

On the left side in the drawing of the arm pieces 15*a* is formed a linking section 15*b* to link the paired arm pieces 15*a*. This linking section 15*b* is formed outside the base 14 with a second slit 14*g* in-between.

At the left end of the arm 15 shown in FIG. 11, the restraining section 15*c* is cut-raised from the linking section 15*b* at a right angle. This restraining section 15*c*, as shown in FIG. 10, extending in the vertical direction in a prescribed width, can restrain the swinging of the swinging board 8 by engaging the left end face 8*b* of the swinging board 8.

At the top of the restraining section 15*c* shown in FIG. 10, there is formed a restraint releasing section 15*d* extended to the left side in the drawing from the restraining section 15*c*. This restraint releasing section 15*d* is formed by folding at a right angle, as shown in FIG. 9, a tip formed extending from the restraining section 15*c*.

When the restraint releasing section 15*d* is subjected to a load in the direction of arrow E, the arm 15 is elastically deformed in the direction of arrow E.

To fit in place the locking member 13 formed in this way, the fitting hole 14*b* of the base 14 is fitted to the right side plate 1*a* of the frame 1, the round hole 14*c* is fitted to the supporting shaft 12, and the base 14 is fitted in tight adherence to the right side plate 1*b* of the frame 1.

When the movable cutter 3 is located in its position as shown in FIG. 1, then the restraint releasing section 15*d* is pressed by the movable cutter 3, and the locking member 13 is in such a state that the arm 15, supported by the fulcrums 14*a*, is elastically deformed in the direction of arrow E to release the swinging board 8 from the restraint by the restraining section 15*c*.

The locking m ember 13, when its base is fitted in tight adherence to the right side plate 1*a* of the frame 1, the protrusion 14*d* elastically energizes the positioner 14*e* at the right end of the base 14 shown in FIG. 11 in a direction away from the right side plate 1*a*.

As a result, the arm 15, when no restraining force in the direction of arrow E is working on the restraint releasing section 15*d*, is elastically energized in the direction of tightly adhering the arm pieces 15*a* to the right side plate 1*a*. Consequently, the left end face 8*b* of the swinging board 8 is securely engaged by the restraining section 15*c* to thereby securely restrain the swinging of the swinging board 8.

In the recording paper cutting mechanism according to the present invention, there is arranged a control unit 21 which, if the shifting of the movable cutter 3 is stopped by some trouble such as jamming of the recording paper, when the paper is being cut as the movable cutter 3 is shifted along the fixed cutter 2 and the revolution of the drive motor 9 is stopped with the power supply thereto remaining active, can detect the stop of this drive motor 9.

The control unit, if it detects that the drive motor 9 remains stopped for a prescribed length of time or longer, reverses the revolution of the drive motor 9 to reverse the rotation of the spiral shaft 4 and thereby to return the movable cutter 3 to its home position H automatically. As a result, even if the shifting of the movable cutter 3 is stopped by some trouble such as jamming of the recording paper, and the revolution of the drive motor 9 is stopped with the power supply thereto remaining active, there is no need to temporarily intercept power supply to the drive motor 9 and to return the movable cutter 3 to its home position H by manually reversing the spiral shaft 4, resulting in increased operating convenience.

The recording paper cutting mechanism according to the invention is configured so that a detecting member (not shown) consisting of a read switch for instance, capable of detecting the return of the movable cutter 3 to its home position H is arranged within the frame 1, and the detection of the return of the movable cutter 3 to its home position H by the detecting member causes the revolution of the drive motor 9 to be reverses from the first to the second direction.

A printer according to the invention having the recording paper cutting mechanism according to the invention, as shown in FIG. 1, has a thermal head 17, which is a printing means, arranged in a position on the frame 1 opposite the paper feed roller 6 with a gap 16 of prescribed dimensions in-between.

A manually operable lever 18 is linked to this thermal head 17. In a position in which recording paper 20 is positioned in the gap 16, by operating the lever 18 to shift the thermal head 17 in the direction of blocking the gap 16 and thereby to bring the thermal head 17 into elastic contact with the paper feed roller 6 via the recording paper, the recording paper is pinched between the thermal head 17 and the paper feed roller 6.

By selectively actuating a plurality of heating elements (not shown) of the thermal head 17 in this state according to printing information and repetitively printing either one line or a plurality of lines at a time on the recording paper, which may be thermosensitive recording paper for instance, a desired image can be printed on the recording paper.

Thus, the paper feed roller 6 has the function of a platen roller which, with the thermal head 17 pressed against it, can print on the recording paper.

The operation of the recording paper cutting mechanism according to the invention having the above-described configuration will now be described. First, in a state in which the movable cutter 3 is located in its home position H, the paper feed roller 6 is turned to feed the recording paper having gone through printing by the thermal head 17 to the cutting means S.

In the locking member 13 during this process, as the restraint releasing section 15*d* is pressed by the movable cutter 3, the restraining section 15*c* of the arm 15 shifts in the direction of arrow E away from the right side plate 1*a* of the frame 1 and, as shown in FIG. 5, the left end face 8*b* of the swinging board 8 is disengaged from the restraining section 15*c* of the arm 15 to release the swinging board 8 from the restraint.

To describe how the toothed wheels are engaged with each other while the recording paper is being fed with reference to FIG. 6, the drive motor 9 is turned in the second direction, i.e. clockwise in the drawing, and this revolution is transmitted to the swinging gear 7 via the second intermediate gear 10 to turn the swinging gear 7 clockwise.

Then, the swinging board 8 swings in the direction of arrow D, and the pinion 7*b* of the swinging gear 7 engages with the second gear 6*b* of the paper feed roller 6. Then the clockwise revolution of the drive motor 9 is transmitted to the paper feed roller 6, which is thereby turned counterclockwise. This counterclockwise rotation of the paper feed roller 6 serves to feed the printed recording paper toward the cutting means S.

The revolution of the drive motor 9 in the second, i.e. clockwise, direction takes on a prescribed frequency and, as this prescribed frequency of the revolution of the drive motor 9 is detected by a control unit 21, control from the control unit 21 switches the revolving direction of the drive motor from the second to the first, i.e. counterclockwise, direction.

Then, the swinging gear 7 turns counterclockwise and, as shown in FIG. 8, the swinging board 8 swings in the direction of arrow C, and the swinging gear 7, engaged with the second gear 6*b* until then, moves away from the second gear 6*b* to engage with the first intermediate gear 5.

The revolution of the drive motor 9 is transmitted to the first gear 4*e* of the spiral shaft 4 to cause the spiral shaft 4 shown in FIG. 8 to turn counterclockwise.

This counterclockwise rotation of the spiral shaft 4 causes the movable cutter 3 to shift in the direction of arrow A away from its home position H as shown in FIG. 3, and a rotary cutting edge 3*a* of the movable cutter 3 and the cutter section 2*a* of the fixed cutter 2 together cut the printed recording paper that has been fed.

The locking member 13 then, by its own elastic force, causes the arm 15 to tightly adhere to the right side plate 1*a* of the frame 1 as shown in FIG. 4 and brings into contact the left end 8*b* of the swinging board 8 with the restraining section 15*c*, resulting in restraint on the swinging of the swinging board 8 in the direction of arrow D as shown in FIG. 8.

Because of this disposition, if the recording paper runs into a jam or the like while the movable cutter 3 is cutting the recording paper and this paper jam stops the shifting of the movable cutter 3 in the direction of arrow A to stop the revolution of the drive motor 9 with the power supply to it remaining active, the duration of the stop of this drive motor 9 is detected by the control unit 21.

If the duration of the stop of the drive motor 9 detected by the control unit 21 surpasses a prescribed upper limit, for instance two seconds, the control unit 21 effects control so as to reverse the revolution of the drive motor 9 into the second, i.e. clockwise, direction.

This reversing of the revolution of the drive motor 9 into the second direction causes a force to work on the swinging board 8 to swing in the direction of arrow D. However, as the swinging board 8 is restrained from swinging by the locking member 13, the revolution of the drive motor 9 in the second direction is transmitted to the first gear 4*e* via the first intermediate gear 5 to reverse the rotation of the spiral shaft 4 into the clockwise direction.

This reversing of the spiral shaft 4 causes the movable cutter 3 shown in FIG. 1 to automatically return in the direction of arrow B, and the movable cutter 3 comes back to its home position H.

Then, the movable cutter 3, having returned to its home position H presses the restraint releasing section 15*d* of the locking member 13 as shown in FIG. 1 to release the swinging of the swinging board 8 from restraint. Then, the swinging board 8, as shown in FIG. 6, swings in the direction of arrow D, and the revolution of the drive motor 9 is transmitted to the paper feed roller 6 to feed the jammed recording paper toward the cutting means S by a prescribed length.

The revolution of the drive motor 9 again in the first, i.e. counterclockwise, direction causes the spiral shaft 4 to turn in the forward direction thereby to shift the movable cutter 3 in the direction of arrow A away from its home position H, and the jammed part of the recording paper to be cut to enable the printing action, which is the initial action of the printer having the recording paper cutting mechanism according to the invention to start again.

As described above, the recording paper cutting mechanism according to the invention, even if the recording paper runs into a jam or the like while it is being cut, the movable cutter 3 can be automatically returned to its home position H and cut the jammed part of the recording paper without having to manipulate the spiral shaft 4 by hand.

Although the foregoing description of the preferred embodiment of the present invention referred to a configuration in which the restraining section 15*c* of the locking member 13 is formed by cut-raising an end of the arm 15, the swinging of the swinging board 8 can as well be restrained by providing a projection (not shown) on the arm 15, boring into the swinging board 8 a hole (not shown) into which the projection on the arm 15 can be fitted, and fitting the projection into the hole in the swinging board 8.

As hitherto described, the invention can provide a recording paper cutting mechanism, in which the movable cutter is shifted along the fixed cutter and the locking member capable of restraining the swinging of the swinging board while the recording paper is being cut is arranged, so that, even if the recording paper runs into a jam or the like while it is being cut and the revolution of the drive motor is reversed to return the movable cutter to its home position, the swinging board is restrained by the locking member from swinging. Because of this configuration, the invention can provide a recording paper cutting mechanism which permits the revolution of the drive motor to be reversed to automatically return the movable cutter to its home position and therefore is convenient to operate.

The return of the movable cutter to its home position after cutting the recording paper releases the swinging board from restraint by the locking member on its swinging to enable the swinging board to swing again, and makes the revolution of the drive gear previously transmitted to the spiral shaft transmissible to the paper feed roller. As a result, by swinging the swinging board, both the feeding of the printed recording paper and the cutting of the fed recording paper can be driven by a single drive motor, and accordingly a low-cost recording paper cutting mechanism can be provided.

If the duration of the stop of the drive motor surpasses a prescribed length of time, it will be detected by the control unit, which then reverses the revolution of the drive motor to return the movable cutter to its home position. As a result, even if the recording paper runs into a jam or the like while it is being cut and the drive motor stops running, the revolution of the drive motor can be automatically reversed to return the movable cutter to its home position, so that the duration of the stop of the drive motor under power supply can be shortened to correspondingly reduce the load on the drive motor.

The locking member consists of an elastically deformable plate member, and the return of the movable cutter to its home position causes the movable cutter to be elastically deformed to release the swinging board from the restraint. As a result, even if the force to return the movable cutter to return to its home position is weak, the locking member can be easily elastically deformed, making it possible to use a motor of a relatively low power output and resulting in a corresponding reduction in cost.

The locking member has a restraining section formed by folding part of the end of the circumference at a right angle, and this restraining section engages an end face of the swinging board to restrain the swinging of the swinging board, with the result that a recording paper cutting mechanism having a highly accurate locking member capable of securely restraining the swinging of the swinging board can be provided.

The locking member has a restraint releasing section formed in part of the restraining section, and the restraint releasing section is operated by the movable cutter returning to its home position to release the swinging board from the restraint. Accordingly, the swinging of the swinging board can be easily released from restraint by having the movable cutter operate the restraint releasing section, and the restraining section can be elastically deformed to easily restrain the swinging from restraint. With a single locking member, the swinging board can be both restrained and released from restraint, resulting in a simply structured recording paper cutting mechanism.

In the home position, there is provided a detecting member capable of detecting the return of the movable cutter there, and the reversing of the movable cutter by this detecting member causes the revolution of the drive motor to be reversed from the first to the second direction. Therefore, switching the revolving direction of this drive motor can cause the swinging board to swing to switch between the action to cut the recording paper and that to feed it, resulting in a simply structured recording paper cutting mechanism.

What is claimed is:

1. A recording paper cutting mechanism comprising:

a drive motor;

a cutting mechanism including a fixed cutter and a movable cutter that moves along the fixed cutter;

a rotatable spiral shaft having spiral grooves to shift the movable cutter;

a rotatable paper feed roller that feeds recording paper toward the cutting mechanism;

a swinging board that swings according to a revolving direction of the drive motor;

a swinging gear fitted swingably to the swinging board, the swinging gear selectively transmitting a revolution of the drive motor to one of the spiral shaft and the paper feed roller according to a swinging direction of the swinging board; and a locking member that restrains the swinging of the swinging board when cutting the recording paper by turning the spiral shaft to shift the movable cutter along the fixed cutter.

2. The recording paper cutting mechanism according to claim 1, wherein:

the movable cutter is in a home position before cutting recording paper; the recording paper is cut by turning the spiral shaft by the revolution of the drive motor to shift the movable cutter away from the home position; and, after the paper cutting, return of the movable cutter to the home position releases the swinging of the swinging board from the restraint by the locking member to enable the swinging board to swing, followed by reversing the revolution of the motor which causes the swinging board to swing thereby to enable the revolution of the drive motor to be transmitted to the paper feed roller.

3. The recording paper cutting mechanism according to claim 2, further comprising:

a detecting member that detects the return of the movable cutter to the home position, and detection by the detecting member of the return of the movable cutter to the home position causes the drive motor to turn in a reverse direction.

4. The recording paper cutting mechanism according to claim 2, further comprising:

a control unit that detects a stop of the drive motor when the shifting of the movable cutter stops while cutting the recording paper and the drive motor stops, wherein the control unit, if it detects that the drive motor remains stopped for at least a prescribed length of time, reverses a revolving direction of the drive motor to reverse the rotation of the spiral shaft and thereby to return the movable cutter to the home position.

5. The recording paper cutting mechanism, according to claim 1, wherein:

the locking member comprises an elastically deformable plate member, and the return of the movable cutter to the home position causes the movable cutter to elastically deform the movable locking member to release the swinging board from the restraint.

6. The recording paper cutting mechanism, according to claim 4, wherein:

the locking member has a restraining section formed by folding, at a right angle, a portion of a peripheral part, and the restraining section engages an end face of the swinging board to restrain the swinging of the swinging board.

7. The recording paper cutting mechanism, according to claim 6, wherein:

the locking member has a restraint releasing section in part of the restraining section, and operation of the restraint releasing section when the movable cutter returns to the home position disengages the swinging board.

* * * * *